US011680538B2

(12) United States Patent
Gaiselmann et al.

(10) Patent No.: US 11,680,538 B2
(45) Date of Patent: Jun. 20, 2023

(54) CYLINDER SLEEVE FOR AN INTERNAL COMBUSTION ENGINE

(71) Applicant: Mahle International GmbH, Stuttgart (DE)

(72) Inventors: Stefan Gaiselmann, Stuttgart (DE); Bartek Lemm, Deizisau (DE); Marco Maurizi, Stuttgart (DE)

(73) Assignee: Mahle International GmbH

( * ) Notice: Subject to any disclaimer, the term of this patent is extended or adjusted under 35 U.S.C. 154(b) by 0 days.

(21) Appl. No.: 17/784,814

(22) PCT Filed: Dec. 9, 2020

(86) PCT No.: PCT/EP2020/085358
§ 371 (c)(1),
(2) Date: Jun. 13, 2022

(87) PCT Pub. No.: WO2021/116218
PCT Pub. Date: Jun. 17, 2021

(65) Prior Publication Data

US 2023/0011925 A1 Jan. 12, 2023

(30) Foreign Application Priority Data

Dec. 11, 2019 (DE) ..... 10 2019 219 378.1

(51) Int. Cl.
*F02F 1/00* (2006.01)

(52) U.S. Cl.
CPC ..... *F02F 1/004* (2013.01)

(58) Field of Classification Search
CPC ..... F02F 1/004; F02F 1/18; F02F 1/20; F02F 1/16
(Continued)

(56) References Cited

U.S. PATENT DOCUMENTS 9,915,220 B2 3/2018 Meirelles Tomanik et al.
10,294,885 B2 5/2019 Bettini Rabello et al.
(Continued)

FOREIGN PATENT DOCUMENTS

DE 1576404 A1 3/1970
DE 102008026146 A1 12/2009
(Continued)

OTHER PUBLICATIONS

English abstract for DE-102013013943.
(Continued)

*Primary Examiner* — Long T Tran
*Assistant Examiner* — James J Kim
(74) *Attorney, Agent, or Firm* — Fishman Stewart PLLC

(57) ABSTRACT

A cylindrical sleeve for an internal combustion engine is disclosed. The cylindrical sleeve includes a hollow cylindrical sleeve body, extending along an axial direction, with an inner peripheral side that has, along the axial direction, a first axial portion and a second axial portion. The inner peripheral side in the first axial portion is either cylindrical or opens at a first opening angle towards the second axial portion. The second axial portion opens at a second opening angle away from the first axial portion that is greater than the first opening angle. A first surface roughness of the inner peripheral side in the first axial portion is greater than a second surface roughness in the second axial portion.

20 Claims, 1 Drawing Sheet

(58) Field of Classification Search
USPC ..... 123/193.2
See application file for complete search history.

(56) References Cited

U.S. PATENT DOCUMENTS

| | | | | |
|---|---|---|---|---|
| 10,760,524 | B2 * | 9/2020 | Takeda | F02F 3/022 |
| 2010/0288222 | A1 * | 11/2010 | Urabe | F16J 10/04 123/193.2 |
| 2015/0377177 | A1 * | 12/2015 | Morgan | C21D 7/08 123/193.2 |
| 2016/0153392 | A1 * | 6/2016 | Meirelles Tomanik | F02F 5/00 123/668 |
| 2016/0303702 | A1 | 10/2016 | Xavier et al. | |
| 2018/0087468 | A1 | 3/2018 | Lach et al. | |

FOREIGN PATENT DOCUMENTS

| | | | |
|---|---|---|---|
| DE | 102011117660 | A1 | 5/2013 |
| DE | 102013013943 | B3 | 1/2015 |
| DE | 102014017361 | A1 | 6/2016 |
| DE | 112014003421 | T5 | 6/2016 |
| DE | 102016205754 | A1 | 10/2017 |
| DE | 102016013932 | A1 | 5/2018 |
| EP | 2976184 | A1 | 1/2016 |
| EP | 3181292 | A1 | 6/2017 |
| WO | 2017174249 | A1 | 10/2017 |

OTHER PUBLICATIONS

English abstract for DE-102011117660.
English abstract for DE-102016205754.
English abstract for DE-102016013932.
English abstract for DE-102008026146.
International Search Report PCT/EP2020/085358, dated Dec. 9, 2020.
German Search Report for DE-102019219378.1, dated Jul. 9, 2020.
English abstract for DE-102014017361.

* cited by examiner

CYLINDER SLEEVE FOR AN INTERNAL COMBUSTION ENGINE

CROSS-REFERENCE TO RELATED APPLICATIONS

This application claim priority to International Patent Application No. PCT/EP2020/085358 filed Dec. 9, 2020, which also claims priority to German Patent Application DE 10 2019 219 378.1 filed Dec. 11, 2019, the contents of each of which is hereby incorporated by reference in their entirety.

TECHNICAL FIELD

The present invention relates to a cylinder sleeve for an internal combustion engine and an internal combustion engine having such a cylinder sleeve. The invention further relates to a motor vehicle having such an internal combustion engine.

BACKGROUND

Cylinder sleeves which open away from the combustion chamber, in order to equalize the thermal expansion occurring principally above in the combustion chamber, are known from the prior art. DE 1 576 404 A1 and DE 10 2013 013943 B3, for example, disclose such cylinder sleeves.

Cylinder sleeves in which a surface roughness of the inner peripheral side of the sleeve varies are also known from the prior art. Against this background, DE 11 2014 003421 T5 proposes providing a surface with a high degree of roughness on the inner peripheral side of the cylinder sleeve both in the region of the upper and also lower reversal point of the piston sliding along the cylinder sleeve. High pressure forces can occur in the two reversal points, owing to the high gas pressure prevailing there and a possible "tilting" of the piston. The deep rough structure of the surface therefore serves to store oil, which permits an effective lubrication of the piston in this region. On the other hand, in the region between the two reversal points, in which the piston can move rapidly, the sliding friction occurring between the piston or respectively its piston rings and the inner peripheral side of the cylinder sleeve can be kept low by provision of a surface with less roughness—therefore through the provision of a smooth(er) surface.

DE10 2014 017 361 A1 combines the idea explained above with the idea of a widening of the cylinder sleeve in the central region, wherein the additional occurring play in the central region further reduces the sliding friction taking place between piston and cylinder sleeve or respectively its piston rings.

It is an object of the present invention to indicate new ways in the development of cylinder sleeves for internal combustion engines.

This problem is solved by the subject of the independent claim(s). Preferred embodiments are the subject of the dependent claims.

SUMMARY

The basic idea of the invention accordingly is to vary, along the axial direction of a cylinder sleeve, both the sleeve diameter and also the surface roughness of the inner peripheral side of the cylinder sleeve establishing the sleeve diameter. It is essential to the invention here to provide a first axial portion of the cylinder sleeve, which in the case of use in an internal combustion engine is associated with the upper reversal point of the piston, therefore facing the combustion chamber, with a greater surface roughness than a second axial portion further remote from the upper reversal point. Here, according to the invention, viewed in the axial direction from the first to the second axial portion, an increase in the sleeve diameter of the cylinder sleeve in the first axial portion is selected to be smaller than in the second axial portion. In this way, in the first axial portion of the cylinder sleeve facing the combustion chamber, it is ensured that the piston is also directed with small radial play and with good lubrication under high gas pressure. In the second axial portion, further remote from the combustion chamber, owing to resulting greater radial play and the reduced surface roughness, the sliding friction between piston and cylinder sleeve is kept very small. As a result, a cylinder sleeve is thus created in which a piston of an internal combustion engine can be directed with particularly low sliding friction, nevertheless in a mechanically precise manner.

A cylinder sleeve, according to the invention, for an internal combustion engine comprises a hollow cylindrical sleeve body extending along an axial direction. Its inner peripheral side has, along the axial direction, at least a first and a second axial portion. The inner peripheral side, preferably in a longitudinal section along the axial direction, in the first axial portion either is cylindrical or opens in the first axial portion toward the second axial portion at a first opening angle, and namely preferably conically. This means that the sleeve diameter of the sleeve body, established by the inner peripheral side, has a constant value along the axial direction in the first axial portion, or that this value increases along the axial direction. In the latter case, the first axial portion therefore tapers away from the second axial portion.

Furthermore, the second axial portion opens at a second opening angle away from the first axial portion, —and namely preferably conically, wherein the second opening angle is greater than the first opening angle possibly present in the first axial portion. This means that the sleeve diameter of the sleeve body, established by the inner peripheral side, along the axial direction in the second axial portion has a value which increases along the axial direction, therefore away from the combustion chamber of the internal combustion engine towards a crankshaft. Here, the value of the sleeve diameter increases more intensively in the second axial portion than in the first axial portion. Typical values for the opening angle in the first axial portion lie in the range between 0 and 5 angle minutes. Typical values for the opening angle in the second axial portion lie in the range between 4 and 25 angle minutes.

According to the invention, a first surface roughness of the inner peripheral side in the first axial portion is greater than a second surface roughness of the inner peripheral side in the second axial portion.

According to a preferred embodiment, the first surface roughness of the inner peripheral side in the first axial portion is Rpk<0.15 mm, wherein Rk<0.5 and Rvk is between 0.2 and 1.5. Rk here is the depth of the roughness core profile, which is also known to the specialist in the art under the designation "core roughness depth". In addition, Rpk is the averaged height of the peaks projecting from the core region, which is also familiar to the relevant specialist in the art under the term "reduced peak height". Finally, Rvk is the averaged depth of the grooves projecting from the core region, which is known to the relevant specialist in the art under the term "reduced groove depth".

According to a further preferred embodiment, the second surface roughness of the inner peripheral side in the second axial portion is Rpk<0.05 mm, wherein Rk<0.15 and Rvk<0.2.

According to an advantageous further development, the sleeve body can have a third axial portion, in which the inner peripheral side is cylindrical or opens at a third opening angle away from the second axial portion, and namely preferably conically. This means that the sleeve diameter of the sleeve body, established by the inner peripheral side, along the axial direction in the third axial portion has a value which along the axial direction either remains the same or increases further with respect to the second portion. In this further development, the second axial portion is arranged axially therefore between the first and third axial portion. In this further development, the sliding friction occurring between the cylinder sleeve and the piston which is directed in the cylinder sleeve is further reduced owing to the additional radial play present in the third portion.

Particularly preferably, a third surface roughness of the inner peripheral side in the third axial portion is less than the first surface roughness in the first axial portion. This provision is also accompanied by improved friction characteristics, in particular reduced friction values, of the cylinder sleeve.

According to a further advantageous further development, a radial widening of the cylinder sleeve measured perpendicularly to the axial direction—proceeding from a central longitudinal axis of the cylinder sleeve—can be up to 100 mm, preferably ca. 50 mm. These values are deemed to be preferred in cylinder sleeves for heavy goods vehicles with typical internal diameters in the range of approximately 120 mm to 140 mm. Independently of the diameter of the respective cylinder sleeve, widenings measured proceeding radially from a central longitudinal axis in a range of 0.025% to 0.05% of the cylinder inner diameter are also regarded as particularly advantageous. The radial play, increasing along the axial direction, accompanying this, reduces in a particularly advantageous manner the sliding friction occurring between piston and cylinder sleeve.

Expediently, in the longitudinal section along the axial direction, the surface line of the inner peripheral side in the first axial portion and—alternatively or additionally—in the second axial portion, can run in a curved manner. Alternatively or additionally, in the longitudinal section along the axial direction, the surface line of the inner peripheral side in the first axial portion and—alternatively or additionally—in the second axial portion, can run in a rectilinear manner. While rectilinear surface lines can delimit a conical or cylindrical space, curved surface lines can produce a progressive or degressive—in particular trumpet-shaped or respectively bell-shaped—widening from the combustion chamber in the direction of the crankshaft. Fine adjustments of the contour of the inner peripheral side of the sleeve body to application-specific requirements are thus possible.

If, furthermore, the sleeve body has the third axial portion, explained above, the inner peripheral side in the third axial portion according to an advantageous further development can run in a curved manner in the longitudinal section along the axial direction. Alternatively thereto, however, it is also conceivable that in the longitudinal section along the axial direction the inner peripheral side in the third axial portion runs in a rectilinear manner. In this way, also, fine adjustments of the contour of the inner peripheral side of the sleeve body to application-specific requirements are possible.

In further preferred variants, it is conceivable that one or more (first) sub-portions of the first, second or/and third axial portion 4*a*, 4*b*, 4*c* are configured in a rectilinear manner and one or more (second) sub-portions of the first, second or/and third axial portion 4*a*, 4*b*, 4*c* are configured in a curved manner.

In a further preferred embodiment, the second axial portion along the axial direction directly adjoins the first axial portion. This embodiment requires particularly little installation space in axial direction.

In a further preferred embodiment, the third axial portion along the axial direction directly adjoins the second axial portion. This embodiment also requires particularly little installation space in axial direction.

The invention further relates to an internal combustion engine for a motor vehicle with at least one cylinder bore, which is delimited on the peripheral side by a cylinder sleeve according to the invention, which was presented above. The advantages of the cylinder sleeve, explained above, are therefore also transferred to the internal combustion engine according to the invention. In the cylinder bore—displaceably along the axial direction of the cylinder sleeve between an upper reversal point and a lower reversal point—a piston of the internal combustion engine is arranged. The internal combustion engine can of course have two or more cylinder bores, respectively with a cylinder sleeve according to the invention and with a piston as explained above. According to the invention, the upper reversal point is arranged in the first axial portion of the cylinder sleeve.

According to a preferred embodiment—in which the cylinder sleeve is configured in particular without a third axial portion, the lower reversal point is arranged in the second axial portion of the cylinder sleeve.

According to a preferred embodiment alternative thereto—in which the cylinder sleeve has the third axial portion explained above—the lower reversal point of the piston can be arranged in precisely this third axial portion of the cylinder sleeve.

Finally, the invention relates to a motor vehicle having an internal combustion engine according to the invention, and thus having at least one cylinder sleeve according to the invention. The advantages, explained above, of the internal combustion engine according to the invention or respectively of the cylinder sleeve according to the invention are therefore also transferred to the motor vehicle according to the invention.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained more closely in the following description, wherein the same reference numbers relate to identical or similar or functionally identical components.

BRIEF DESCRIPTION OF THE DRAWINGS

There are shown, respectively schematically.

DETAILED DESCRIPTION

Figure 1:
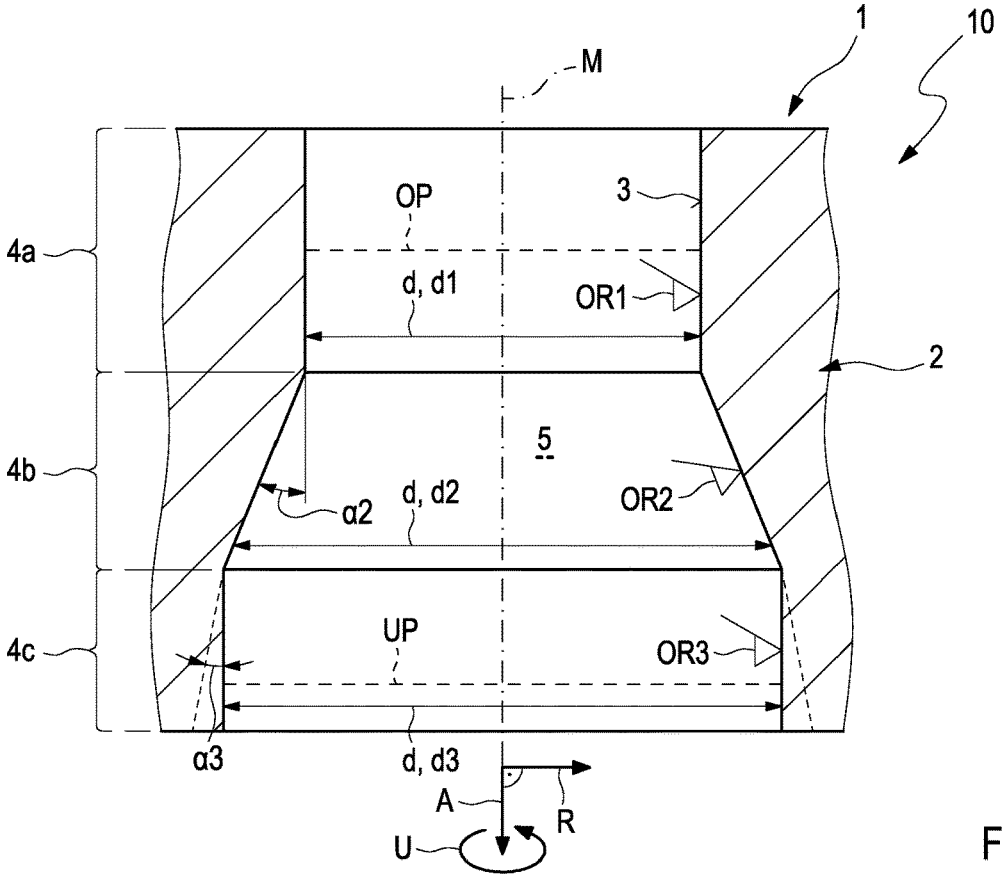
FIG. 1 a first example of a cylinder sleeve according to the invention, in which the first axial portion of the inner peripheral side is cylindrical, therefore without opening angle, FIG. 2 a second example of a cylinder sleeve according to the invention, in which the first axial portion of the inner peripheral side opens conically towards the second axial portion.

FIG. 1 illustrates in a longitudinal section along an axial direction A a first example of a cylinder sleeve 1 according to the invention for an internal combustion engine, not illustrated, of a motor vehicle. The cylinder sleeve 1 comprises a hollow cylindrical sleeve body 2, extending along the axial direction A, the inner peripheral side 3 of which along the axial direction A has a first, second and third second axial portion 4*a*, 4*b*, 4*c*. The second axial portion 4*b* is arranged along the axial direction A between the first and third axial portion 4*a*, 4*c*.

The axial direction A extends along a central longitudinal axis M of the sleeve body 2, a radial direction extends perpendicularly to the axis direction A away from the central longitudinal axis A. A circumferential direction U runs—extending perpendicularly both to the axial direction A and also to the radial direction R—around the central longitudinal axis M. In a simplified variant of the example (not shown), the third axial portion 4*c* can be dispensed with.

Aluminium, steel or cast iron for example come into consideration as material for the sleeve body 2.

In the example of FIG. 1, the inner peripheral side 3 in the first axial portion 4*a* as shown is cylindrical—therefore without an opening and without narrowing and thus with an opening angle of zero. The inner peripheral side 3 therefore extends in the first axial portion 4*a* along the axial direction A and parallel to the central longitudinal axis M. This means that the sleeve diameter d of the sleeve body 2, established by the surface line of the inner peripheral side 3 has a constant value d1 along the axial direction A in the first axial portion 4*a*.

Figure 2:
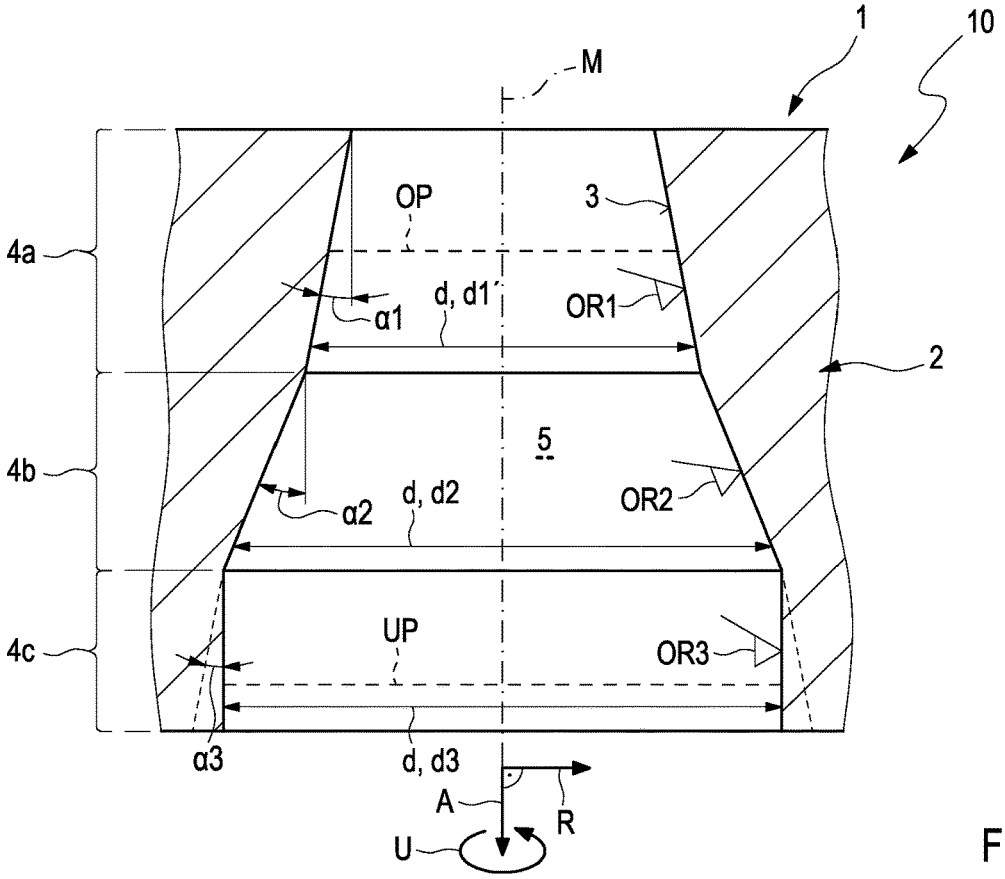

FIG. 2 shows an alternative scenario thereto. Accordingly, the first axial portion 4*a* can open—preferably conically—at a first opening angle a1 towards the second axial portion, therefore away from the second axial portion 4*b*. In the longitudinal section which is shown along the axial direction A, the opening angle a1 corresponds to the intermediate angle between the first axial portion 4*a* of the inner peripheral side 3 and the central longitudinal axis M of the sleeve body 2. This means that the sleeve diameter d of the sleeve body 2, established through the surface line of the inner peripheral side 3 along the axial direction A in the first axial portion 4*a* has an increasing value d1' along the axial direction A.

Both in the example of FIG. 1 and also in that of FIG. 2, the second axial portion 4*b* opens at a second opening angle a2 away from the first axial portion, and namely preferably conically. In the longitudinal section respectively shown in the figures along the axial direction A, the opening angle a2 corresponds to the intermediate angle between the second axial portion 4*b* of the inner peripheral side 3 and the central longitudinal axis M of the sleeve body 2.

This means that the sleeve diameter d of the sleeve body 2, established through the inner peripheral side 3, along the axial direction A in the second axial portion 4*b* has a value d2 increasing along the axial direction A. Here, the second opening angle a2 of the second axial portion 4*b* is greater than the possibly present first opening angle a1 of the first axial portion 4*a*. This means that the value d2 of the sleeve diameter d in the second axial portion 4*b* increases more intensively than the value d1' of the sleeve diameter d in the first axial portion 4*a*. The two opening angles a1, a2 are illustrated in an enlarged manner in FIGS. 1 and 2 for reasons of better illustration. Typical values for the opening angle a1 lie in the range between 0 and 5 angle minutes. Typical values for the opening angle a2 lie in the range between 4 and 25 angle minutes.

In addition, the sleeve body 2 in both examples, as shown in FIGS. 1 and 2, can have a third axial portion 4*c*, in which the inner peripheral side 3 is cylindrical or opens at a third opening angle a3 away from the second axial portion 4*c*—preferably conically—(illustrated respectively in dashed lines in FIGS. 1, 2). This means that the value d3 of the sleeve diameter d of the sleeve body 2, established through the inner peripheral side 3, along the axial direction A in the third portion 4*c* has a constant value d3 or increases. In a respectively simplified variant, both of the example of FIG. 1 and also of the example of FIG. 2, the third axial portion 4*c* can be dispensed with.

In each of the example scenarios explained above, a widening of the cylinder sleeve 1, measured proceeding from the central longitudinal axis M along the radial direction R, therefore perpendicularly to the axial direction A, can be up to 100 mm, preferably ca. 50 mm.

In the examples of FIGS. 1 and 2, a first surface roughness OR1 of the inner peripheral side 3 in the first axial portion 4*a* is greater than a second surface roughness OR 2 in the second axial portion 4*b*. Furthermore, a third surface roughness OR 3 of the inner peripheral side 3 in the third axial portion 4*c*—if this third portion 4*c* is present—is smaller than the first surface roughness OR1. In an embodiment variant, the third surface roughness OR 3 can be identical to the second surface roughness OR2, alternatively thereto, however, it can also be smaller or greater than the second surface roughness OR2. The surface roughness of the inner peripheral side 3 is therefore maximal in the region of the first axial portion 4*a*, i.e. OR1>OR2. If applicable also OR1>OR3.

For example, the first surface roughness OR1 of the inner peripheral side 3 in the first axial portion 4*a* can be characterized by a value Rpk<0.15 mm, by a value Rk<0.5 and by a value Rvk between 0.2 and 1.5. In addition, the second surface roughness OR2 of the surface of the inner peripheral side in the second axial portion 4*b* can have a value Rpk<0.05 mm and a value Rk<0.15 and Rvk a value<0.2. Rk here is the depth of the roughness core profile, therefore the so-called "core roughness depth". In addition, Rpk is the averaged height of the peaks projecting from the core region, therefore the so-called "reduced peak height". Finally, Rvk is the averaged depth of the grooves projecting from the core region, therefore the so-called "reduced groove depth".

The desired surface roughnesses can be produced by honing the respective axial portion 4*a*, 4*b*, 4*c* of the inner peripheral side 3. The application of a texturing is also conceivable, for example by means of a suitable laser- or etching process, onto the respective axial portion 4*a*, 4*b*, 4*c* of the inner peripheral side 3.

In the longitudinal section, shown in the two FIG. 1 and along the axial direction A the inner peripheral side 3 runs in the first, second and third axial portion 4*a*, 4*b*, 4*c* respectively in a rectilinear manner. However, a curved configuration of two or of all three axial portions 4*a*, 4*b*, 4*c* is also conceivable (not shown in the figures for the sake of clarity). It is also conceivable that one or more (first) sub-portions of the first, second or/and third axial portion 4*a*, 4*b*, 4*c* are configured in a rectilinear manner and one or more (second) sub-portions of the first, second or/and third axial portion 4*a*, 4*b*, 4*c* are configured in a curved manner.

In the example of FIGS. 1 and 2, the second axial portion 4*b* directly adjoins the first axial portion 4*a* along the axial direction A. Likewise, the third axial portion 4*c* directly adjoins the second axial portion 4*b* along the axial direction A. The three portions 4*a*, 4*b*, 4*c* therefore merge directly into one another.

In a first optional variant of the examples, between the first and second axial portion 4*a*, 4*b* an axial intermediate portion (not shown) with a suitable contour shape of the inner peripheral side 3—cylindrical or with opening angle and in a rectilinear or curved manner—can be formed.

In a second optional variant of the examples, between the second and the third axial portion 4*b*, 4*c* an axial intermediate portion (not shown) with a suitable contour shape of the inner peripheral side 3—cylindrical or with opening angle and in a rectilinear or curved manner—can be formed. The first variant can be combined with the second variant.

The cylinder sleeve 1 of FIGS. 1 and 2 can be used in an internal combustion engine 10, so that it delimits a cylinder bore 5 of the internal combustion engine on the peripheral side. The internal combustion engine 10 comprises here a piston, arranged displaceably in the cylinder bore 5 along the axial direction A of the cylinder sleeve 1 between an upper reversal point OP and a lower reversal point UP, which piston is not illustrated in the figures, for clarity.

As the figures demonstrate, the upper reversal point OP is arranged in the first axial portion 4*a* of the cylinder sleeve 1. The lower reversal point UP is arranged in the third axial portion 4*c*. In the case of the above-mentioned, simplified variants of the cylinder sleeve 1 without a third axial portion 4*c*, the lower reversal point UP can be arranged in the second axial portion 4*b*.

The invention claimed is:

1. A cylinder sleeve for an internal combustion engine, comprising:

a hollow cylindrical sleeve body, extending along an axial direction, with an inner peripheral side that has, along the axial direction, a first axial portion and a second axial portion, wherein the inner peripheral side in the first axial portion is either cylindrical or opens at a first opening angle toward the second axial portion, wherein the second axial portion opens at a second opening angle away from the first axial portion that is greater than the first opening angle, and wherein a first surface roughness of the inner peripheral side in the first axial portion is greater than a second surface roughness in the second axial portion.

2. The cylinder sleeve according to claim 1, wherein the first surface roughness of the inner peripheral side in the first axial portion is Rpk<0.15 mm, wherein Rk<0.5 and Rvk is between 0.2 and 1.5.

3. The cylinder sleeve according to claim 1, wherein the second surface roughness of the inner peripheral side in the second axial portion is Rpk<0.05 mm, wherein Rk<0.15 and Rvk<0.2.

4. The cylinder sleeve according to claim 1, wherein the sleeve body has a third axial portion where the inner peripheral side is cylindrical or opens at a third opening angle away from the second axial portion, wherein the second axial portion is arranged in the axial direction between the first axial portion and the third axial portion.

5. The cylinder sleeve according to claim 4, wherein a third surface roughness of the inner peripheral side in the third axial portion is less than the first surface roughness in the first axial portion.

6. The cylinder sleeve according to claim 1, wherein a radial widening of the cylinder sleeve, measured perpendicularly to the axial direction, is 1 mm to 100 mm.

7. The cylinder sleeve according to claim 1, wherein at least one of:

in a longitudinal section along the axial direction, a surface line of the inner peripheral side in at least one of the first axial portion and the second axial portion runs in a curved manner; and in the longitudinal section along the axial direction, the surface line of the inner peripheral side in at least one of the first axial portion and the second axial portion runs in a rectilinear manner.

8. The cylinder sleeve according to claim 4, wherein at least one of:

in a longitudinal section along the axial direction, a surface line of the inner peripheral side in the third axial portion runs in a curved manner; and in the longitudinal section along the axial direction, the surface line of the inner peripheral side in the third axial portion runs in a rectilinear manner.

9. The cylinder sleeve according to claim 1, wherein the second axial portion along the axial direction directly adjoins the first axial portion.

10. The cylinder sleeve according to claim 4, wherein the third axial portion along the axial direction directly adjoins the second axial portion.

11. An internal combustion engine for a motor vehicle, comprising:

at least one cylinder bore delimited on a peripheral side by a cylinder sleeve, the cylinder sleeve including:

a hollow cylindrical sleeve body, extending along an axial direction, with an inner peripheral side that has, along the axial direction, a first axial portion and a second axial portion, wherein the inner peripheral side in the first axial portion is either cylindrical or opens at a first opening angle towards the second axial portion, wherein the second axial portion opens at a second opening angle away from the first axial portion, the second opening angle being greater than the first opening angle, wherein the inner peripheral side has a first surface roughness in the first axial portion that is greater than a second surface roughness in the second axial portion, with a piston arranged displaceably in the at least one cylinder bore along the axial direction of the cylinder sleeve between an upper reversal point and a lower reversal point, and wherein the upper reversal point is arranged in the first axial portion of the cylinder sleeve.

12. The internal combustion engine according to claim 11, wherein the lower reversal point is arranged in the second axial portion of the cylinder sleeve.

13. The internal combustion engine according to claim 11, wherein the lower reversal point is arranged in a third axial portion of the cylinder sleeve, wherein the third portion is cylindrical or opens at a third opening angle away from the second axial portion, and the second axial portion is arranged in the axial direction between the first axial portion and the third axial portion.

14. A motor vehicle, comprising: an internal combustion engine, the internal combustion engine including:

at least one cylinder bore delimited on a peripheral side by a cylinder sleeve, the cylinder sleeve including:

a hollow cylindrical sleeve body, extending along an axial direction, with an inner peripheral side that has, along the axial direction, a first axial portion and a second axial portion, wherein the inner peripheral side in the first axial portion is either cylindrical or opens at a first opening angle towards the second axial portion, wherein the second axial portion opens at a second opening angle away from the first axial portion, the second opening angle being greater than the first opening angle, wherein the inner peripheral side has a first surface roughness in the first axial portion that is greater than a second surface roughness in the second axial portion, a piston arranged displaceably in the at least one cylinder bore along the axial direction of the cylinder sleeve between an upper reversal point and a lower reversal point, and wherein the upper reversal point is arranged in the first axial portion of the cylinder sleeve.

15. The motor vehicle according to claim 14, wherein at least one of:

the first surface roughness of the inner peripheral side in the first axial portion is Rpk<0.15 mm, wherein Rk<0.5 and Rvk is between 0.2 and 1.5; and the second surface roughness of the inner peripheral side in the second axial portion is Rpk<0.05 mm, wherein Rk<0.15 and Rvk<0.2.

16. The internal combustion engine according to claim 11, wherein a radial widening of the cylinder sleeve measured perpendicularly to the axial direction is 1 mm to 100 mm.

17. The internal combustion engine according to claim 11, wherein at least one of:

the first surface roughness of the inner peripheral side in the first axial portion is Rpk<0.15 mm, wherein Rk<0.5 and Rvk is between 0.2 and 1.5; and the second surface roughness of the inner peripheral side in the second axial portion is Rpk<0.05 mm, wherein Rk<0.15 and Rvk<0.2.

18. The internal combustion engine according to claim 13, wherein a third surface roughness of the inner peripheral side in the third axial portion is less than the first surface roughness in the first axial portion.

19. The cylinder sleeve according to claim 1, wherein the first axial portion opens conically at the first opening angle towards the second axial portion.

20. The cylinder sleeve according to claim 1, wherein the second axial portion opens conically at the second opening angle.

* * * * *